US009285713B2

(12) United States Patent
Saito et al.

(10) Patent No.: US 9,285,713 B2
(45) Date of Patent: Mar. 15, 2016

(54) DEVELOPING DEVICE, AND IMAGE FORMING APPARATUS PROVIDED WITH THE SAME

(71) Applicant: KYOCERA Document Solutions Inc., Osaka-shi, Osaka (JP)

(72) Inventors: Sakae Saito, Osaka (JP); Hiroaki Sakai, Osaka (JP); Yukimasa Watanabe, Osaka (JP); Yasuhiro Oishi, Osaka (JP); Masashi Fujishima, Osaka (JP); Chikara Ishihara, Osaka (JP); Yasuhiro Tauchi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/680,147

(22) Filed: Apr. 7, 2015

(65) Prior Publication Data

US 2015/0293477 A1 Oct. 15, 2015

(30) Foreign Application Priority Data

Apr. 14, 2014 (JP) ..... 2014-082587

(51) Int. Cl.
*G03G 15/09* (2006.01)
*G03G 15/08* (2006.01)

(52) U.S. Cl.
CPC ..... *G03G 15/0907* (2013.01); *G03G 15/0818* (2013.01)

(58) Field of Classification Search
CPC ..... G03G 15/0907; G03G 15/0806; G03G 15/0818
USPC ..... 399/279, 286; 492/18, 53, 56
See application file for complete search history.

(56) References Cited

U.S. PATENT DOCUMENTS 5,617,191 A * 4/1997 Murakami ..... B05D 1/28 399/286 X
5,970,294 A * 10/1999 Narita ..... B29C 57/00 399/279 X
5,991,571 A * 11/1999 Yamada ..... G03G 15/0928 399/279 X
5,995,792 A * 11/1999 Jo ..... G03G 15/0817 399/279
7,203,451 B2 * 4/2007 Kayahara ..... G03G 15/0808 399/286
7,826,781 B2 * 11/2010 Fujishima ..... G03G 15/0818 399/279 X
8,292,791 B2 * 10/2012 Akama ..... G03G 15/0233 399/286
2005/0185981 A1 * 8/2005 Ohshika ..... G03G 15/0817 399/279 X
2006/0204286 A1 * 9/2006 Tsubota ..... G03G 15/0818 399/286

FOREIGN PATENT DOCUMENTS

JP 2012-163900 8/2012

* cited by examiner

*Primary Examiner* — Sophia S Chen
(74) *Attorney, Agent, or Firm* — Gerald E. Hespos; Michael J. Porco; Matthew T. Hespos

(57) ABSTRACT

A developing device supplies a developer to a photosensitive drum, which has a cylindrical shape, and is rotatable around an axis thereof for forming an electrostatic latent image on the circumferential surface thereof. The developing device is provided with a developing roller. The developing roller is disposed to face the photosensitive drum, and has a cylindrical shape. The developing roller is rotatable around an axis thereof for carrying a developer on the circumferential surface thereof. The developing roller is provided with a small diameter portion. The small diameter portion is a part of the circumferential surface of the developing roller. The small diameter portion extends from an axial end of the developing roller axially inward by a predetermined length, and has an outer diameter smaller than an axially middle portion of the developing roller.

10 Claims, 9 Drawing Sheets

DEVELOPING DEVICE, AND IMAGE FORMING APPARATUS PROVIDED WITH THE SAME

This application is based on Japanese Patent Application No. 2014-082587 filed on Apr. 14, 2014, the contents of which are hereby incorporated by reference.

BACKGROUND

The present disclosure relates to a developing device, and an image forming apparatus provided with the same.

In an image forming apparatus using an electrophotography method such as a copying machine, a printer, and a facsimile machine, a developing device supplies toner to an electrostatic latent image formed on a photosensitive drum, and the electrostatic latent image is developed to form a toner image on the photosensitive drum. As one of the methods for performing the developing operation, there is known a touch-down developing method, in which a two-component developer containing non-magnetic toner and magnetic carriers is used. In this configuration, a two-component developer layer (so-called magnetic brush layer) is formed on a magnetic roller. Toner is moved from the two-component developer layer to a developing roller to carry a toner layer. Conventionally, there is known a technique, in which a resin layer is formed on the surface of a developing roller. Further, there is known an immersion process (a dip process or a dipping process) of immersing a raw pipe of a developing roller in a resin solution in which a resin material is dissolved in advance in order to manufacture the developing roller.

SUMMARY

A developing device according to an aspect of the present disclosure supplies a developer to a photosensitive drum, which has a cylindrical shape, and is rotatable around an axis thereof for forming an electrostatic latent image on the circumferential surface thereof. The developing device is provided with a developing roller. The developing roller is disposed to face the photosensitive drum, and has a cylindrical shape. The developing roller is rotatable around an axis thereof for carrying a developer on the circumferential surface thereof. The developing roller is provided with a small diameter portion. The small diameter portion is a part of the circumferential surface of the developing roller. The small diameter portion extends from an axial end of the developing roller axially inward by a predetermined length, and has an outer diameter smaller than an axially middle portion of the developing roller.

An image forming apparatus according to another aspect of the present disclosure is provided with the developing device having the aforementioned configuration, and a photosensitive drum. A developer is supplied from the developing roller to the photosensitive drum.

These and other objects, features and advantages of the present disclosure will become more apparent upon reading the following detailed description along with the accompanying drawings.

DETAILED DESCRIPTION

In the following, embodiments of the present disclosure are described in details, based on the drawings. The present disclosure is applicable to an image forming apparatus using an electrophotography method such as a copying machine, a printer, a facsimile machine, and a complex machine provided with the functions of these machines.

Figure 1:
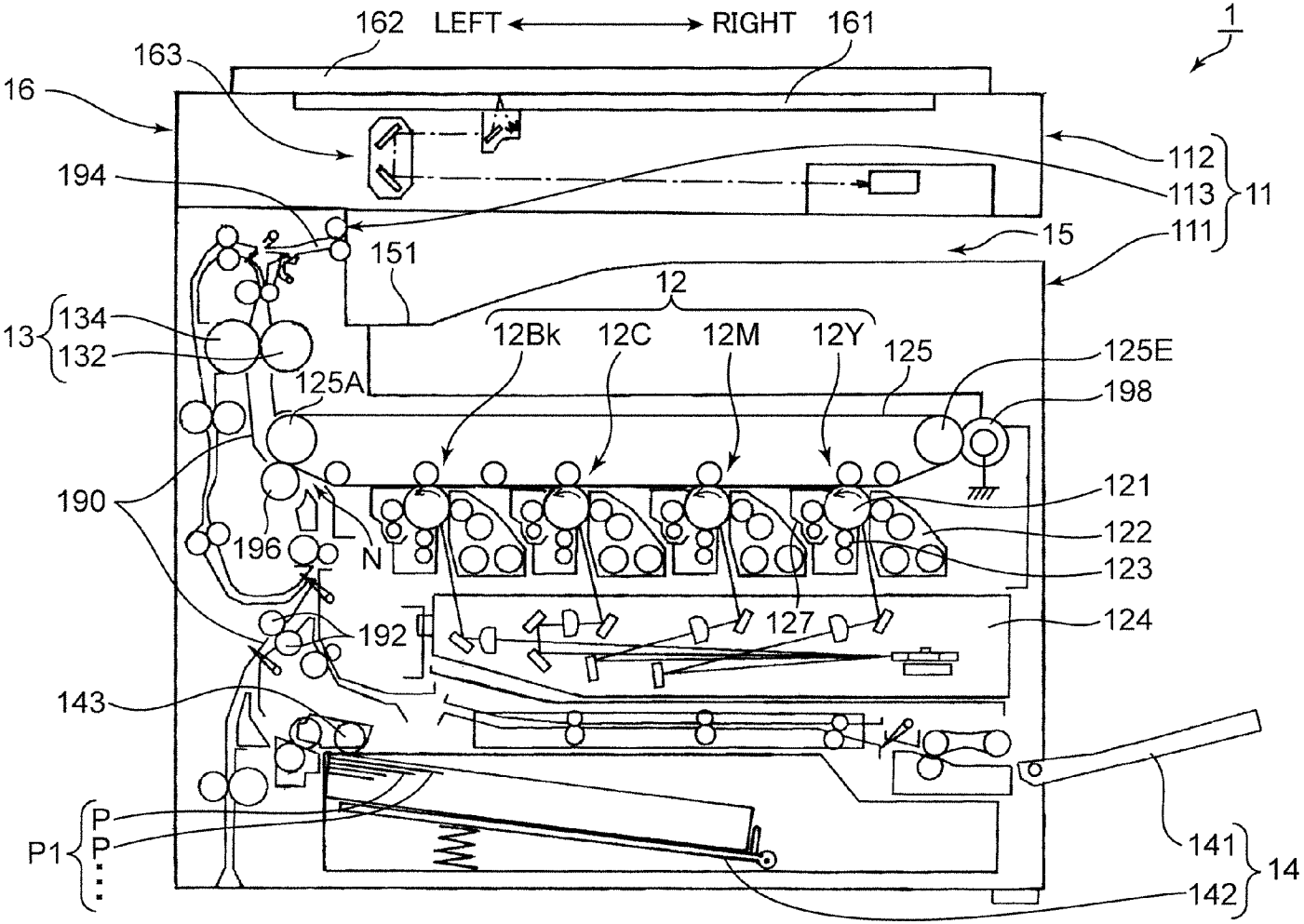
FIG. 1 is a sectional view illustrating an inner structure of an image forming apparatus embodying the present disclosure.

FIG. 1 is a sectional front view illustrating a structure of an image forming apparatus 1 embodying the present disclosure. The image forming apparatus 1 is provided with an apparatus main body 11. An image forming section 12, a fixing device 13, a sheet feeding portion 14, a sheet discharging portion 15, and a document reading portion 16 are provided in the apparatus main body 11.

The apparatus main body 11 is provided with a lower main body 111, an upper main body 112 disposed above the lower main body 111 to face the lower main body 111, and a connecting portion 113 disposed between the upper main body 112 and the lower main body 111. The connecting portion 113 is a structural member for connecting the lower main body 111 and the upper main body 112 in a state that the sheet discharging portion 15 is formed between the lower main body 111 and the upper main body 112. The connecting portion 113 stands upright from a left portion and a rear portion of the lower main body 111, and has an L-shape in plan view. The upper main body 112 is supported on the upper end of the connecting portion 113.

The image forming section 12, the fixing device 13, and the sheet feeding portion 14 are provided in the lower main body 111. The document reading portion 16 is mounted on the upper main body 112.

The image forming section 12 performs an image forming operation of forming a toner image on a sheet P fed from the sheet feeding portion 14. The image forming section 12 is provided with a yellow image forming unit 12Y using yellow toner, a magenta image forming unit 12M using magenta toner, a cyan image forming unit 12C using cyan toner, and a black image forming unit 12Bk using black toner, which are horizontally arranged in this order from upstream toward downstream; an intermediate transfer belt 125 wound around and stretched between rollers including a drive roller 125A to run endlessly in a sub scanning direction during an image forming operation; a secondary transfer roller 196 which comes into contact with the outer surface of the intermediate transfer belt 125; and a belt cleaning device 198.

Each of the image forming units 12Y, 12M, 12C, and 12Bk of the image forming section 12 is integrally provided with a photosensitive drum 121, a developing device 122 for supplying toner (a developer) to the photosensitive drum 121, a toner cartridge (not illustrated) for accommodating toner, a charging device 123, and a drum cleaning device 127. Further, an exposure device 124 is horizontally disposed at a position adjacent to and below the developing devices 122 for irradiating the photosensitive drums 121.

The photosensitive drum 121 has a cylindrical shape, and is rotated around an axis thereof. The photosensitive drum 121 forms an electrostatic latent image on the circumferential surface thereof, and carries a toner image obtained by developing the electrostatic latent image with toner. In the embodiment, the photosensitive drum 121 is a well-known organic (OPC) photosensitive member. A charge generation layer, a charge transport layer, and the like are formed on the surface of the photosensitive drum 121 by the same immersion process as applied to manufacture a developing roller 83 to be described later.

The developing device 122 supplies toner to an electrostatic latent image on the circumferential surface of the photosensitive drum 121, which is rotated in the arrow direction, for depositing the toner, and forms a toner image in accordance with image data on the circumferential surface of the photosensitive drum 121. Toner is replenished from the toner cartridge to each of the developing devices 122, as necessary.

The charging device 123 is provided at a position immediately below each of the photosensitive drums 121. The charging device 123 uniformly charges the circumferential surface of the photosensitive drum 121.

The exposure device 124 is provided at a position below the charging devices 123. The exposure device 124 emits laser light corresponding to each color based on image data input from a computer or a like device, or based on image data acquired in the document reading portion 16 to the circumferential surface of each of the charged photosensitive drums 121 for forming an electrostatic latent image on the circumferential surface of each of the photosensitive drums 121. The exposure device 124 emits the laser light in accordance with a predetermined exposure light amount in order to form a latent image of a predetermined potential on the photosensitive drum 121. The drum cleaning device 127 is provided on the left of each of the photosensitive drums 121 to remove the toner residues on the circumferential surface of the photosensitive drum 121 for cleaning the photosensitive drum 121.

The intermediate transfer belt 125 is an endless belt, and is a soft and conductive belt having a laminate structure constituted of a base layer, an elastic layer, and a coat layer. The intermediate transfer belt 125 is wound around and stretched between substantially horizontally disposed stretching rollers at a position above the image forming section 12. The stretching rollers include the drive roller 125A disposed near the fixing device 13, and configured to drive and rotate the intermediate transfer belt 125; and a driven roller 125E disposed horizontally away from the drive roller 125A by a predetermined distance, and configured to be driven and rotated in association with the intermediate transfer belt 125. The intermediate transfer belt 125 is driven to circulate clockwise in FIG. 1 when a rotational driving force is applied to the drive roller 125A.

The secondary transfer roller 196 is electrically connected to a secondary transfer bias application portion (not illustrated). A toner image formed on the intermediate transfer belt 125 is transferred to a sheet P transported from a transport roller pair 192 disposed below the secondary transfer roller 196 when a transfer bias voltage is applied between the secondary transfer roller 196 and the drive roller 125A. The belt cleaning device 198 is disposed to face the driven roller 125E on the outside of the driven roller 125E via the intermediate transfer belt 125.

The fixing device 13 is provided with a heating roller 132 internally provided with an electric heater such as a halogen lamp, which is a heating source, and a pressing roller 134 disposed to face the heating roller 132. The fixing device 13 performs a fixing process with respect to a toner image on a sheet P which has undergone a transfer process in the image forming section 12 by transferring heat of the heating roller 132 during a time when the sheet P passes a fixing nip portion between the heating roller 132 and the pressing roller 134. The sheet P carrying a color image, which has undergone the fixing process, is discharged toward a sheet discharge tray 151 provided at a top portion of the apparatus main body 11 through a sheet discharge transport path 194 extending from an upper portion of the fixing device 13.

The sheet feeding portion 14 is provided with a manual tray 141 which is openably and closably mounted on the right wall of the apparatus main body 11 in FIG. 1, and a sheet cassette 142 detachably mounted at a position lower than the exposure device 124 within the apparatus main body 11. The sheet cassette 142 is capable of accommodating a sheet stack P1 constituted of a number of sheets P. A pickup roller 143 is mounted above the sheet cassette 142. The pickup roller 143 feeds the uppermost sheet P of the sheet stack P1 accommodated in the sheet cassette 142 toward a sheet transport path 190. The manual tray 141 is a tray provided at a lower position on the right surface of the lower main body 111 for manually feeding sheets P one by one toward the image forming section 12.

The sheet transport path 190 extending in up and down directions is formed on the left of the image forming section 12. A transport roller pair 192 is provided at an appropriate position on the sheet transport path 190. The transport roller pair 192 transports a sheet P fed from the sheet feeding portion 14 toward a secondary transfer nip portion including the secondary transfer roller 196.

The sheet discharging portion 15 is formed between the lower main body 111 and the upper main body 112. The sheet discharging portion 15 is provided with the sheet discharge tray 151 formed on the upper surface of the lower main body 111. The sheet discharge tray 151 is a tray on which a sheet P carrying a toner image formed in the image forming section 12 is discharged after having undergone a fixing process in the fixing device 13.

The document reading portion 16 is provided with a contact glass 161 mounted in an opening of the upper surface of the upper main body 112 for placing a document thereon, a document pressing cover 162 which is provided openably and closably for pressing a document placed on the contact glass 161, and a scanning mechanism 163 for scanning a document placed on the contact glass 161 to read the image of the document. The scanning mechanism 163 optically reads a document image, using an image sensor such as a CCD (Charge Coupled Device) image sensor or a CMOS (Complementary Metal Oxide Semiconductor) image sensor to generate image data. Further, the apparatus main body 11 includes an image processing portion (not illustrated) for generating an image to be processed from the image data <Configuration of Developing Device>

Figure 2:
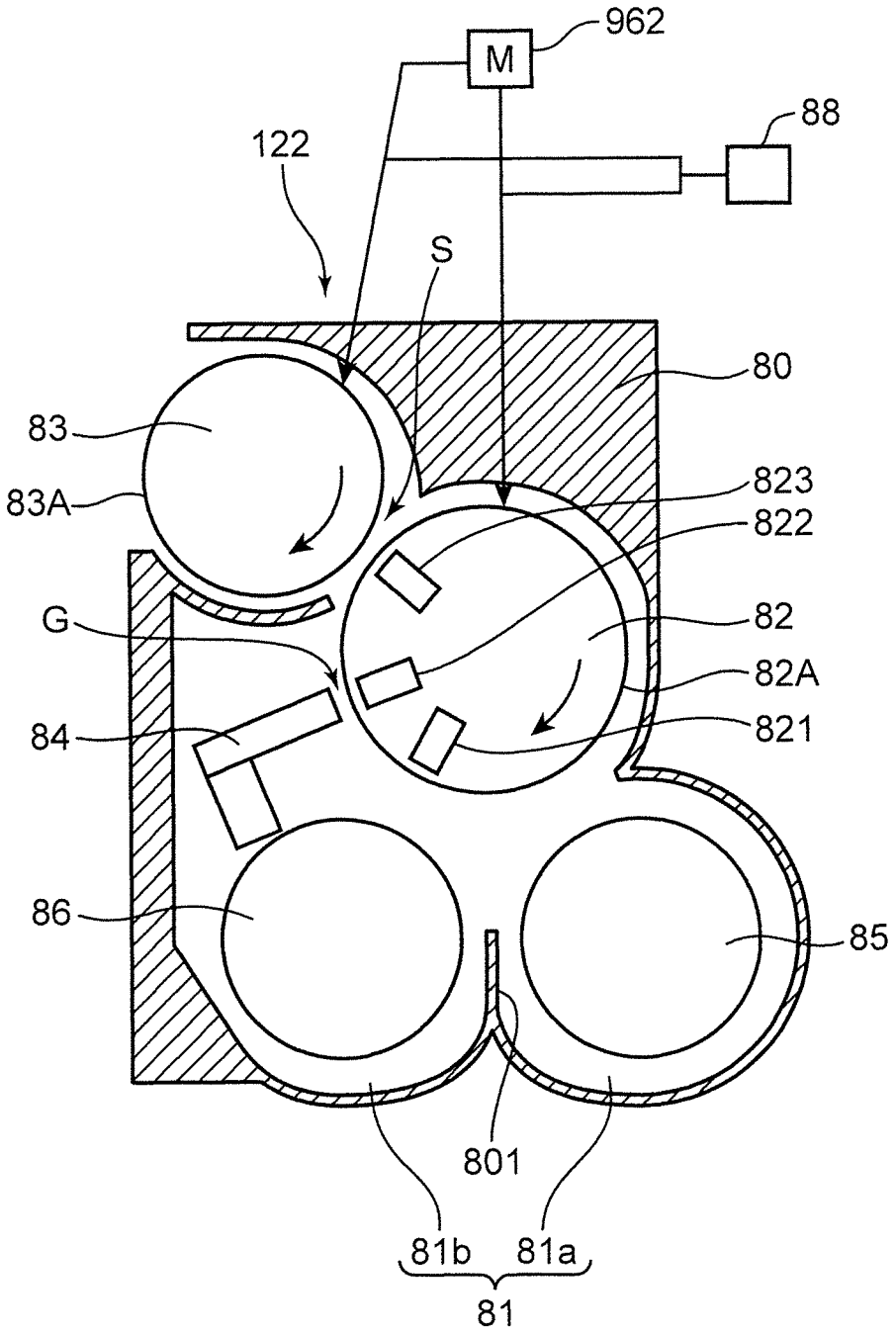
FIG. 2 is a sectional view of a developing device in the embodiment of the present disclosure.

In this section, the developing device 122 is described in detail. FIG. 2 is a sectional view schematically illustrating an inner structure of the developing device 122 in up and down directions and in left and right directions. The developing device 122 in the embodiment employs a touchdown developing method provided with the developing roller 83 and a magnetic roller 82 to be described later. The developing device 122 includes a developing housing 80 for defining an inner space of the developing device 122. The developing housing 80 is provided with a developer storage portion 81 for storing a developer containing non-magnetic toner, which is charged at a predetermined polarity, and magnetic carriers. Further, the developing housing 80 is internally provided with the magnetic roller 82 which is disposed above the developer storage portion 81, the developing roller 83 which is disposed to face the magnetic roller 82 at an obliquely upper position of the magnetic roller 82, and a developer restraining blade 84 which is disposed to face the magnetic roller 82. Further, the developing device 122 is provided with a driving portion 962 and a developing bias application portion 88 (bias application portion) (see FIG. 2).

The developer storage portion 81 includes two developer storage chambers 81*a* and 81*b* adjacent to each other and extending in the length direction of the developing device 122. The developer storage chambers 81*a* and 81*b* are separated from each other by a partition plate 801 which is integrally formed with the developing housing 80 and extends in the length direction. The developer storage chambers 81*a* and 81*b* are communicated with each other by an unillustrated communication path at both ends of the partition plate 801 in the length direction (axis direction). Screw feeders 85 and 86 for agitating and transporting a developer by rotations around the axes thereof are housed in the developer storage chambers 81*a* and 81*b*, respectively. The screw feeders 85 and 86 are driven and rotated by an unillustrated driving mechanism. The rotating directions of the screw feeders 85 and 86 are set to be opposite to each other. According to this configuration, a developer is circulated and transported between the developer storage chamber 81*a* and the developer storage chamber 81*b*, while being agitated. By the agitation, the toner and the carriers are mixed, and the toner is positively charged, for instance.

The magnetic roller 82 is disposed to extend along the length direction of the developing device 122. In FIG. 2, the magnetic roller 82 is driven and rotated clockwise. A fixed-type magnet roll (fixed magnet, not illustrated) is disposed inside the magnetic roller 82. The magnet roll has a plurality of poles. In the embodiment, the magnet roll has a scooping pole 821, a restraining pole 822, and a main pole 823. The scooping pole 821 faces the developer storage portion 81. The restraining pole 822 faces the developer restraining blade 84. The main pole 823 faces the developing roller 83.

The magnetic roller 82 magnetically scoops (receives) the developer from the developer storage portion 81 to a circumferential surface 82A of the magnetic roller 82 by a magnetic force of the scooping pole 821. The magnetic roller 82 magnetically holds the scooped developer on the circumferential surface 82A as a developer layer (magnetic brush layer). As the magnetic roller 82 is rotated, the developer is transported toward the developer restraining blade 84.

The developer restraining blade 84 is disposed upstream of the developing roller 83 with respect to the rotating direction of the magnetic roller 82, and restrains the layer thickness of the developer layer that has been magnetically deposited on the circumferential surface 82A of the magnetic roller 82. Further, the developer restraining blade 84 forms a restraining gap G of a predetermined size between the developer restraining blade 84 and the circumferential surface 82A of the magnetic roller 82. According to this configuration, a uniform developer layer of a predetermined thickness is formed on the circumferential surface 82A.

The developing roller 83 is disposed to extend along the length direction of the developing device 122 and in parallel to the magnetic roller 82. The developing roller 83 is driven and rotated clockwise in FIG. 2. The developing roller 83 is disposed to face the photosensitive drum 121. The developing roller 83 has a cylindrical shape, and is rotated around the axis thereof. The developing roller 83 includes a circumferential surface 83A for receiving toner from the developer layer to carry a toner layer, while rotating in contact with the developer layer held on the circumferential surface 82A of the magnetic roller 82. When a developing operation is performed, the developing roller 83 supplies toner of the toner layer to the circumferential surface of the photosensitive drum 121. In the embodiment, the developing roller 83 is a roller configured such that a resin coat (nylon coat) is coated on the surface of anodized aluminum.

The developing roller 83 and the magnetic roller 82 are driven and rotated by the driving portion 962. A clearance S of a predetermined size is formed between the circumferential surface 83A of the developing roller 83 and the circumferential surface 82A of the magnetic roller 82. The clearance S is set to 0.3 mm, for instance. The developing roller 83 is disposed to face the photosensitive drum 121 through an opening formed in the developing housing 80. A clearance of a predetermined size is formed between the circumferential surface 83A and the circumferential surface of the photosensitive drum 121. In the embodiment, the clearance is set to 0.12 mm. Further, the developing bias application portion 88 applies a developing bias voltage obtained by superimposing an alternate-current voltage with a direct-current voltage to the magnetic roller 82 and to the developing roller 83.

The following is an example of developing bias voltages to be applied to the magnetic roller 82 and to the developing roller 83 by the developing bias application portion 88 during a developing operation.

DC voltage Vmag_dc of magnetic roller 82: 300 V

DC voltage Vslv_dc of developing roller 83: 50 V

AC voltage (Vpp) Vmag_ac between developing roller 83 and magnetic roller 82: 1800 V (4.7 kHz)

AC voltage (Vpp) Vslv_ac of developing roller 83: 1300 V (4.7 kHz)

Duty ratio of AC voltage of developing roller 83: 45%

Duty ratio of AC voltage between developing roller 83 and magnetic roller 82: 70%

Potential VL of image portion on photosensitive drum 121: +20 V

Potential Vo of background portion on photosensitive drum 121: +230 V

As described above, a high AC voltage is applied between the photosensitive drum 121 and the developing roller 83, and between the developing roller 83 and the magnetic roller 82. In particular, toner is supplied from the magnetic roller 82 to the developing roller 83, and then, toner is supplied from the developing roller 83 to the photosensitive drum 121. Therefore, as compared with a well-known one component developing device and two-component developing device, a high AC voltage is applied to the developing roller 83 in order to move toner.

Figure 3A:
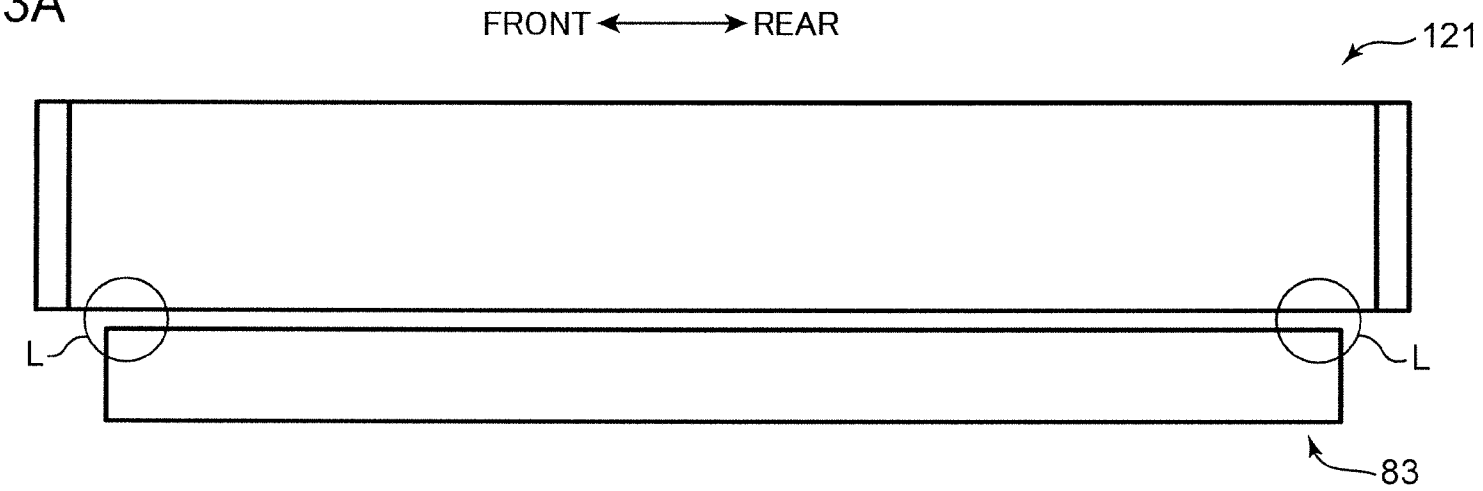
FIG. 3A is a schematic diagram illustrating a relationship between the axial length of a photosensitive drum and the axial length of a developing roller in a first embodiment of the present disclosure.
Figure 3B:
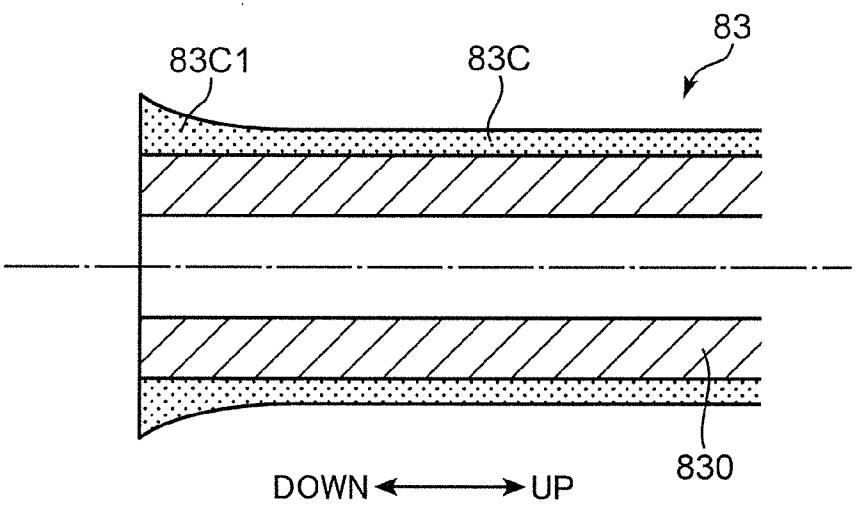
FIG. 3B is a schematic sectional view illustrating a condition of a layer thickness of an end of the developing roller in the first embodiment of the present disclosure.
Figure 4A:
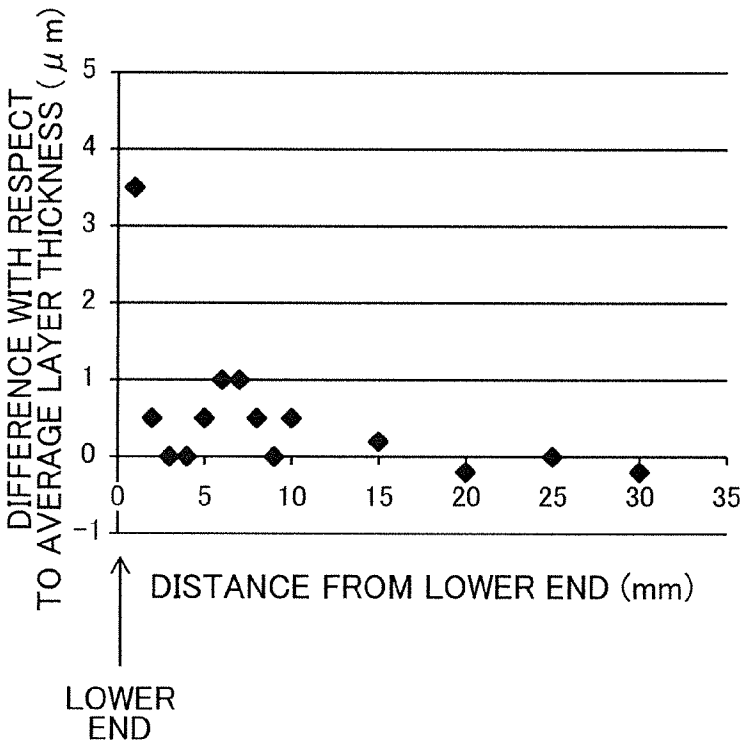
FIG. 4A is a graph illustrating a layer thickness distribution of the developing roller in the axis direction thereof in the first embodiment of the present disclosure.
Figure 4B:
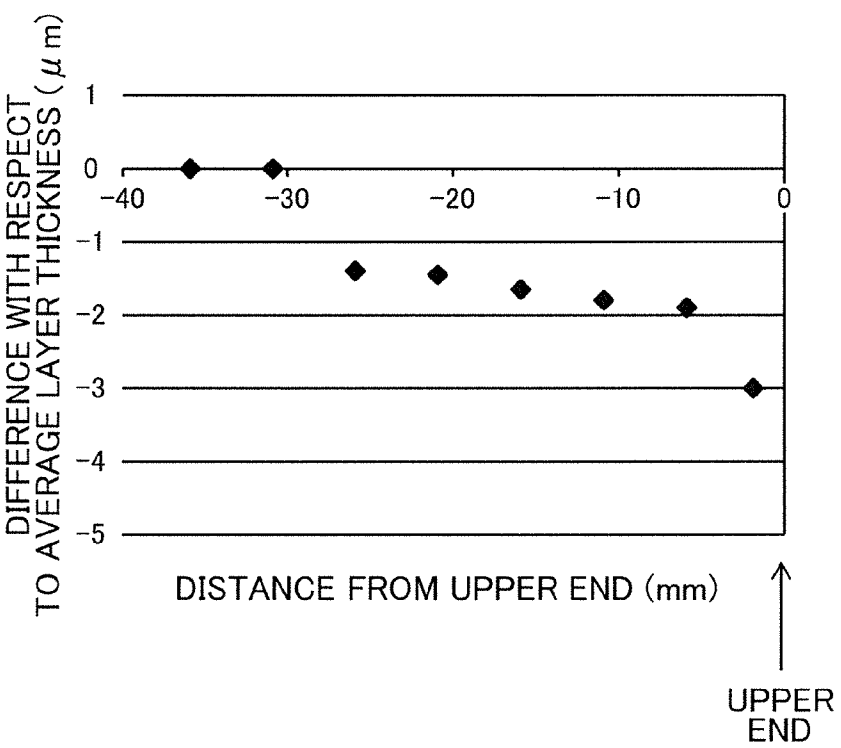
FIG. 4B is a graph illustrating a layer thickness distribution of the developing roller in the axis direction thereof in the first embodiment of the present disclosure.
Figure 5:
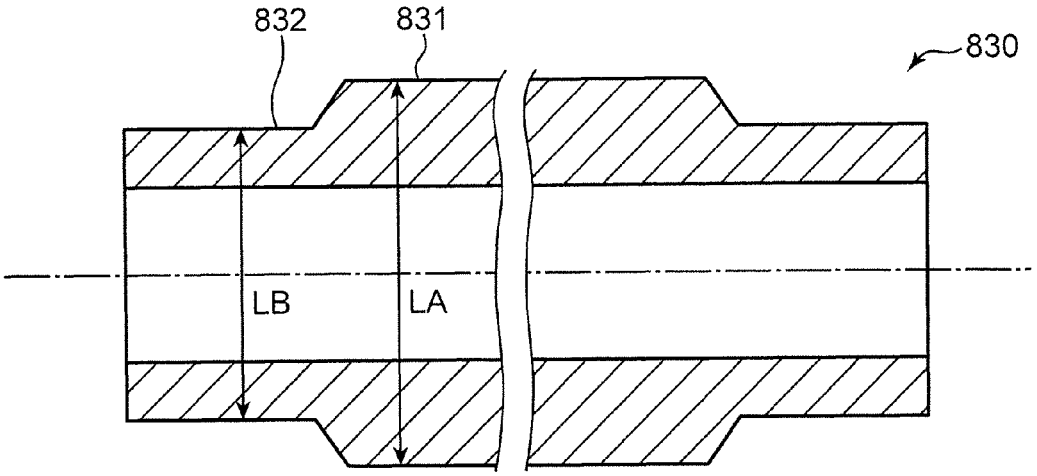
FIG. 5 is a sectional view of a base member of the developing roller in the first embodiment of the present disclosure.
Figure 6B:
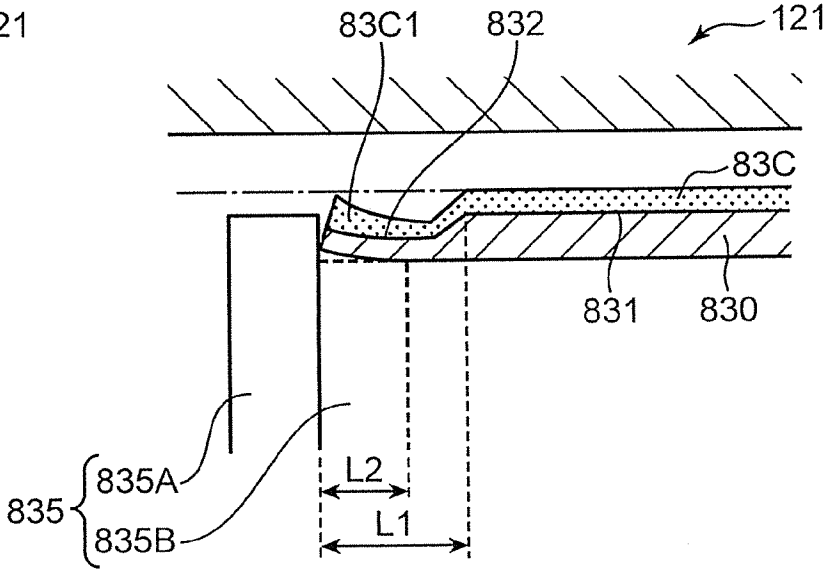
FIG. 6B is a sectional view illustrating a state that a flange portion is mounted in the developing roller in the first embodiment of the present disclosure.

Next, the photosensitive drum 121 and the developing roller 83 in a first embodiment of the present disclosure are described in detail, referring to FIG. 3A to FIG. 6B. FIG. 3A is a schematic diagram illustrating a relationship between the axial length of the photosensitive drum 121 and the axial length of the developing roller 83 in the embodiment. FIG. 3B is a schematic sectional view illustrating a condition of a layer thickness of a coat layer 83C at an end of the developing roller 83. FIG. 4A and FIG. 4B are graphs illustrating a layer thickness distribution of the coat layer 83C of the developing roller 83 in the axis direction. FIG. 5 is a sectional view of a sleeve 830 of the developing roller 83. FIG. 6A is a sectional view illustrating a state that a flange portion is mounted in a developing roller as a comparative example of the developing roller 83 in the embodiment. FIG. 6B is a sectional view illustrating a state that a flange portion is mounted in the developing roller 83 in the embodiment.

Referring to FIG. 3A, in the embodiment, the axial length of the photosensitive drum 121 is set to be longer than the axial length of the developing roller 83. Therefore, both axial ends of the developing roller 83 face the photosensitive drum 121 in portions L on the inner side of both axial ends of the photosensitive drum 121. Referring to FIG. 3B and FIG. 6B, the developing roller 83 is provided with the sleeve 830 (base member) having a cylindrical shape, and a pair of flange portions 835 to be mounted on both axial ends of the sleeve 830. The sleeve 830 is made of aluminum. Further, the sleeve 830 is provided with the coat layer 83C (surface layer) made of resin. The coat layer 83C is formed by an immersion process to be described later. Further, the flange portion 835 is provided with a flange end portion 835A and a press-fitting portion 835B. The flange end portions 835A expose from both ends of the sleeve 830. The press-fitting portion 835B is pressed in the inner periphery of the sleeve 830. Further, the sleeve 830 is provided with a sleeve middle portion 831 (middle portion), and a sleeve small diameter portion 832 (small diameter portion) (see FIG. 5). The sleeve middle portion 831 is a portion located at an axially middle portion of the sleeve 830. On the other hand, the sleeve small diameter portion 832 is a portion which extends from an axial end of the sleeve 830 axially inward by a predetermined length, and has an outer diameter smaller than the sleeve middle portion 831. Specifically, in FIG. 5, the outer diameter LA of the sleeve middle portion 831 is set to be larger than the outer diameter LB of the sleeve small diameter portion 832. The sleeve small diameter portion 832 is disposed on the axially outer side of an image forming area on the photosensitive drum 121.

The coat layer 83C of the sleeve 830 is manufactured by the following steps. First of all, anodized aluminum is coated on the outer surface of the sleeve 830 to form an anodized aluminum layer (oxidized layer) of 10 μm in thickness. Forming an oxidized layer on the sleeve 830 made of aluminum makes it possible to increase the adhesion force of the coat layer 83C with respect to a base member. As a result of this treatment, peeling off of the coat layer 83C is prevented. Thereafter, the surface of the sleeve 830, specifically, the surface of the anodized aluminum layer is heat treated at 120° C. for 10 minutes or longer. The heat treatment is performed to intentionally cause cracks in the sleeve 830 in advance for preventing generation of cracks in a drying step of the coat layer 83C. The time of the heat treatment is set in advance. For instance, the time of the heat treatment is set to be equal or longer than the time required for the drying step. The heat treatment is always performed at a predetermined temperature for a predetermined time. Cracks of a substantially fixed quantity are generated in all the sleeves 830 which have undergone the heat treatment. A process of forming the coat layer 83C is performed after the heat treatment. Specifically, a mixed solution is prepared by mixing nylon resin as a binder resin, titanium oxide as a conductive agent, and methanol 800 (parts by weight) as a dispersant medium with zirconia beads of 1.0 mm in diameter in a ball mill for about 48 hours. The sleeve 830 treated with anodized aluminum is immersed in the mixed solution for a predetermined time, and then is taken out from the mixed solution. The sleeve 830 is dried in a high-temperature environment of 130° C. for 10 minutes. The sleeve 830 is immersed in the mixed solution in such a manner that the axis direction of the sleeve 830 having a cylindrical shape is aligned with a vertical direction. As a result of the immersion operation, a sleeve 830 coated with a coat layer 830C of a thickness in the range of from 2 μm to 11 μm is manufactured. As described above, cracks are generated in the anodized aluminum layer in advance by the heat treatment, before the coat layer 83C is coated. This makes it possible to prevent local distribution of a conductive agent contained in the coat layer 83C due to the influence of a convection current, which may be generated inside the coat layer 83C at the time of drying the coat layer 83C. Thus, it is possible to form a coat layer 83C in which a conductive agent is uniformly distributed.

On the other hand, when a coat layer 83C is formed by the aforementioned immersion process, the mixed solution adhered to the surface of a sleeve 830 is likely to droop due to the influence of gravitational force at the time of taking out the sleeve 830. As a result, when an immersion operation is performed, a coat layer 83C having a large thickness, as compared with an axially middle portion of the sleeve 830, may be formed on the surface of a lower end of the sleeve 830. In particular, a thick portion 83C1 (see FIG. 3B) where the thickness of the coat layer 83C is large is likely to be formed at a lower end of the sleeve 830. Further, when an immersion operation is performed, a thin coat layer 83C, as compared with an axially middle portion of the sleeve 830, is likely to be formed on the surface of an upper end of the sleeve 830.

FIG. 4A illustrates a layer thickness distribution of the coat layer 83C formed on a lower end of the sleeve 830. On the other hand, FIG. 4B illustrates a layer thickness distribution of the coat layer 83C formed on an upper end of the sleeve 830. In both of the drawings, the horizontal axis denotes a distance from an end of the sleeve 830, and the vertical axis denotes a layer thickness at each position in the axis direction, as a difference with respect to an average layer thickness of the coat layer 83C. As illustrated in FIG. 4A and FIG. 4B, the length of the upper end where the coat layer 83C has a small thickness is longer than the length of the lower end where the coat layer 83C has a large thickness. Further, the maximum amount (3 μm) of reduction of the layer thickness of the coat layer 83C at the upper end is approximate to the maximum amount (3.5 μm) of increase of the layer thickness of the coat layer 83C at the lower end.

Figure 6A:
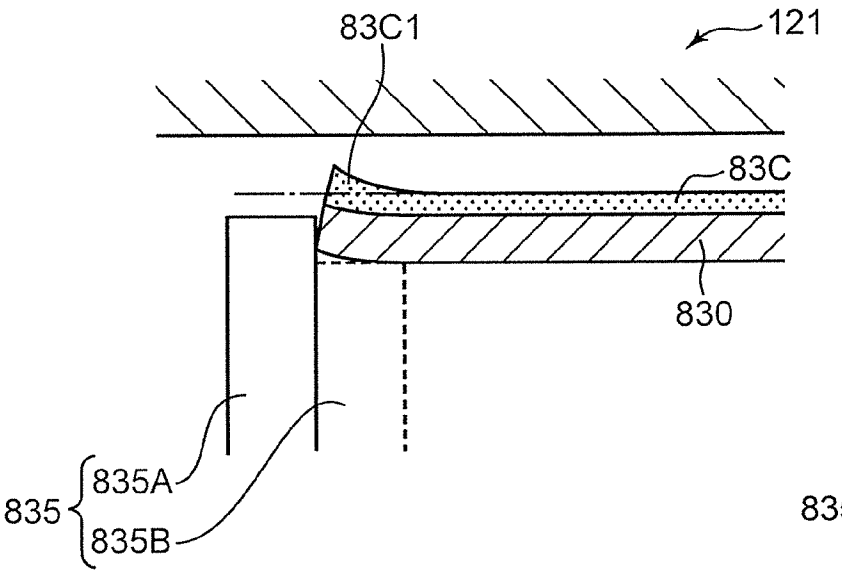
FIG.6A (PRIOR ART)
FIG. 6A is a sectional view illustrating a state that a flange portion is mounted in a developing roller as a comparative example of the developing roller in the embodiment of the present disclosure.

Further, as described above, in the embodiment, the flange portions 835 are mounted in the sleeve 830. FIG. 6A is a schematic sectional view of a case, in which the sleeve small diameter portion 832 (see FIG. 6B) is not formed on a sleeve 830 in a substantially same configuration as in the embodiment. When the press-fitting portion 835B of the flange portion 835 is pressed in the end of the sleeve 830, as illustrated in FIG. 6A, the outer diameter of the end of the sleeve 830 is slightly expanded. As a result of the above operation, the end of the coat layer 83C is expanded radially outward. Therefore, the gap between the photosensitive drum 121 and the developing roller 83 is partially reduced. This may cause voltage leakage when a developing bias voltage (AC voltage) is applied. Further, as described above, when the thick portion 83C1 is formed at the lower end of the coat layer 83C, the gap between the photosensitive drum 121 and the developing roller 83 may be further reduced.

In order to overcome the aforementioned drawbacks, the developing roller 83 in the embodiment is provided with the sleeve small diameter portion 832 as described above. Referring to FIG. 6B, the sleeve small diameter portion 832 is formed by cutting the lower end of the sleeve 830 in advance, before the coat layer 83C is formed on the sleeve 830 by an immersion process. Forming the coat layer 83C after formation of the sleeve small diameter portion 832 as described above makes it possible to form the coat layer 83C along a step between the sleeve middle portion 831 and the sleeve small diameter portion 832. In this case, the thick portion 83C1 is slightly formed at the lower end of the coat layer 83C. As illustrated in FIG. 6B, when the press-fitting portion 835B of the flange portion 835 is pressed in the end of the sleeve 830, the sleeve small diameter portion 832 is deformed to radially outwardly expand. However, the sleeve small diameter portion 832 has a smaller diameter than the sleeve middle portion 831. Therefore, the surface of the thick portion 83C1 is substantially axially flush with the surface of the coat layer 83C on the sleeve middle portion 831. This makes it possible to prevent partial reduction of the gap between the developing roller 83 and the photosensitive drum 121 at the axial end of the developing roller 83. This is advantageous in preventing voltage leakage. In particular, the sleeve small diameter portion 832 is formed on the developing roller 83 whose axial length is shorter between the photosensitive drum 121 and the developing roller 83. Therefore, this is further advantageous in preventing voltage leakage at the axial end of the developing roller 83. It is possible to set the outer diameter of the sleeve small diameter portion 832 so that the outer diameter of the thick portion 83C1 after the pressing operation is smaller than the outer diameter of the coat layer 83C on the sleeve middle portion 831 in order to prevent local voltage leakage at the thick portion 83C1.

Further, in the embodiment, referring to FIG. 6B, the axial length L1 of the sleeve small diameter portion 832 is set to be longer than the axial length L2 of the press-fitting portion 835B. This is further advantageous in preventing partial reduction of the gap between the developing roller 83 and the photosensitive drum 121 due to a pressing operation of the press-fitting portion 835B.

Furthermore, in the embodiment, the developing device 122 is a touchdown developing device provided with the magnetic roller 82 and the developing roller 83. As described above, even in a configuration in which a large AC voltage is applied to the developing roller 83, it is possible to stably prevent voltage leakage by the existence of the sleeve small diameter portion 832.

Figure 7:
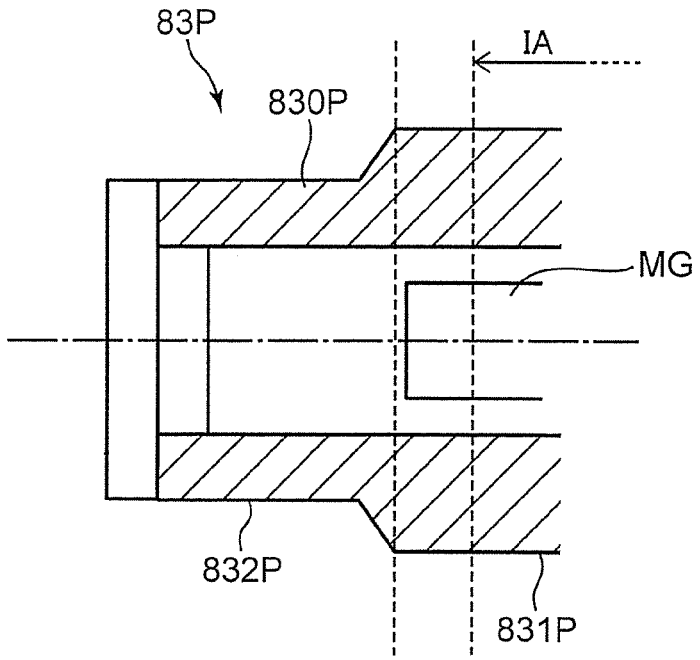
FIG. 7 is a sectional view of an end of a developing roller in a second embodiment of the present disclosure.

Next, a developing roller 83P in a second embodiment of the present disclosure is described referring to FIG. 7. FIG. 7 is a sectional view of an end of the developing roller 83P. In the second embodiment, the axial length of the developing roller 83P is also set to be shorter than the axial length of an unillustrated photosensitive drum. A sleeve small diameter portion 832P (small diameter portion) is formed at an end of a sleeve 830P (base member) of the developing roller 83P. Unlike the developing roller 83 in the first embodiment, the developing roller 83P carries magnetized toner on the circumferential surface thereof. In view of the above, as well as the magnetic roller 82 described in the first embodiment, the developing roller 83P is internally provided with a fixed magnet MG extending in the axis direction of the developing roller 83P. The axial length of the fixed magnet MG is set to be smaller than the axial length of the developing roller 83P. Further, an image forming area IA where an electrostatic latent image is formed on the circumferential surface of the photosensitive drum is set in an area of a size shorter than the axial length of the fixed magnet MG.

As illustrated in FIG. 7, in the second embodiment, a sleeve small diameter portion 832P is located on the axially outer side of the image forming area IA on the photosensitive drum. Therefore, the image forming area IA is included in a sleeve middle portion 831P. According to this configuration, even when the gap between the developing roller 83P and the photosensitive drum is partially varied in the periphery of the sleeve small diameter portion 832P, it is possible to stably and precisely perform a developing operation of developing an electrostatic latent image on the photosensitive drum using a developer with a certain gap. Further, the sleeve small diameter portion 832P is disposed on the axially outer side of the fixed magnet MG. This configuration makes it possible to prevent magnetized toner from adhering to the periphery of the sleeve small diameter portion 832P. This is advantageous in stably implementing a developing operation of developing an electrostatic latent image on the photosensitive drum using toner. Furthermore, magnetized toner is less likely to adhere to the sleeve small diameter portion 832P. Therefore, it is possible to prevent voltage leakage by way of magnetized toner. Also in the second embodiment, a coat layer may be formed on the circumferential surface of the sleeve 830P by an immersion process.

Figure 8:
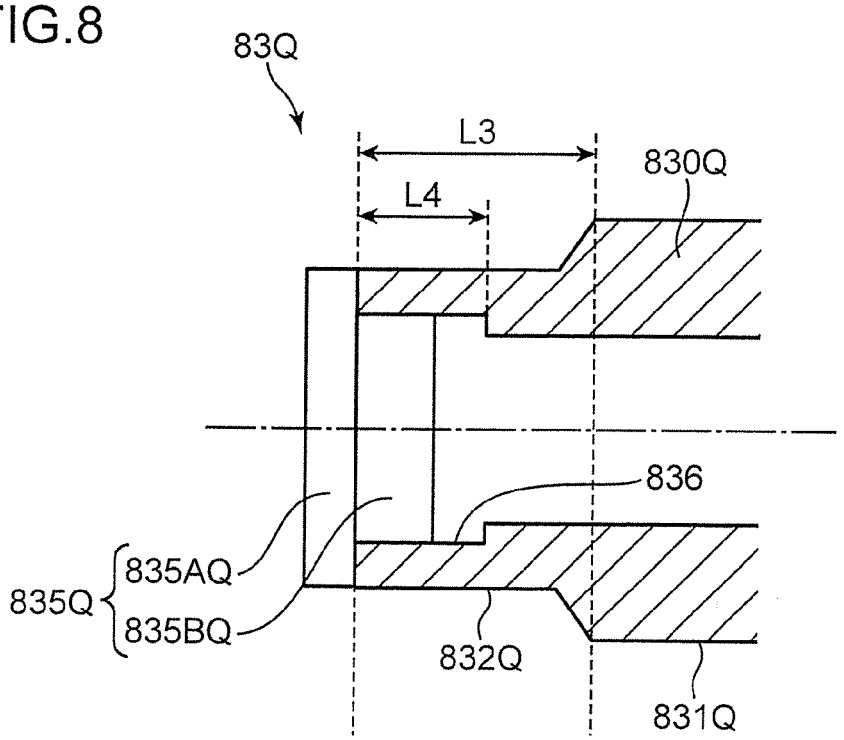
FIG. 8 is a sectional view of an end of a developing roller in a third embodiment of the present disclosure.

Next, a developing roller 83Q in a third embodiment of the present disclosure is described referring to FIG. 8. FIG. 8 is a sectional view of an end of the developing roller 83Q. In the third embodiment, the axial length of the developing roller 83Q is also set to be shorter than the axial length of an unillustrated photosensitive drum. A sleeve small diameter portion 832Q (small diameter portion) is formed on an end of a sleeve 830Q (base member) of the developing roller 83Q. The developing roller 83Q is provided with a flange portion 835Q that includes a flange end portion 835AQ and a press fitting portion 435BQ. The press-fitting portion 835BQ of the flange portion 835Q is pressed in an end of the sleeve 830Q. Unlike the developing roller 83 in the first embodiment, the sleeve 830Q of the developing roller 83Q is provided with an in-low portion 836 (press-fitted portion). The in-low portion 836 is a portion whose inner diameter is set to be large at an axial end of the sleeve 830Q. The press-fitting portion 835BQ of the flange portion 835Q is pressed in the in-low portion 836. The axial length L3 of the sleeve small diameter portion 832Q is set to be longer than the axial length L4 of the in-low portion 836.

Providing the in-low portion 836 in advance in the sleeve 830Q makes it easy to implement a pressing operation of the press-fitting portion 835BQ. The in-low portion 836, however, has a relatively small thickness, as compared with the other portion, and is likely to be deformed. In view of the above, the sleeve small diameter portion 832Q is formed in a large area, as compared with the in-low portion 836. Therefore, even when the sleeve small diameter portion 832Q located on the outer side of the in-low portion 836 is radially expanded due to a pressing operation of the press-fitting portion 835BQ, it is possible to prevent the sleeve small diameter portion 832Q from bulging toward the photosensitive drum with respect to the sleeve middle portion 831Q. Thus, the above configuration is advantageous in preventing partial reduction of the gap between the developing roller 83Q and the photosensitive drum, and in preventing voltage leakage.

Figure 9:
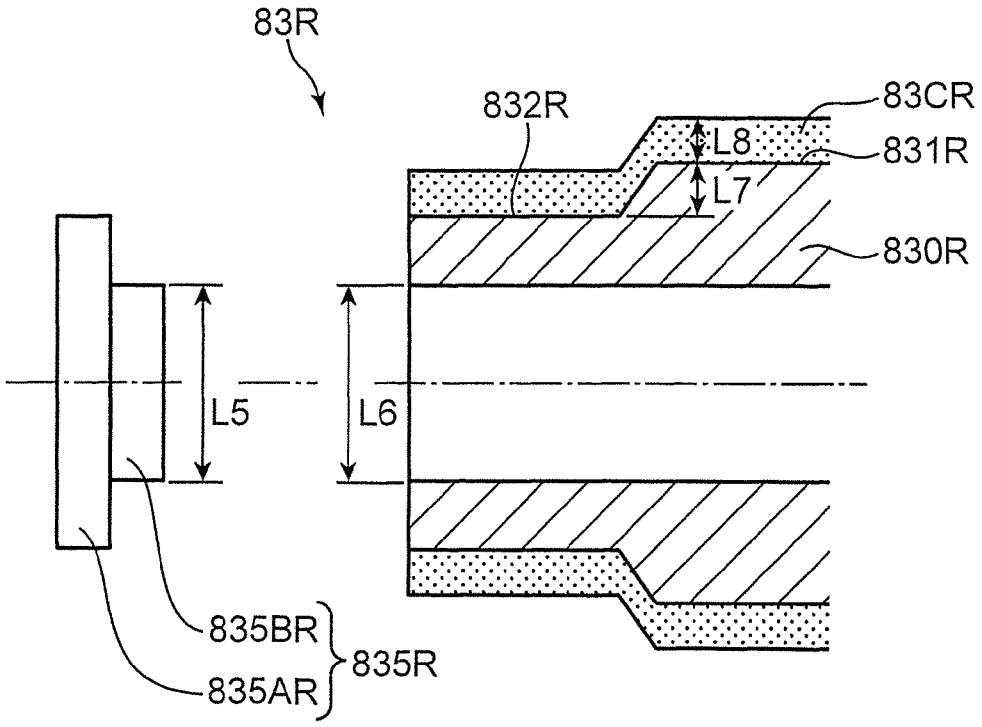
FIG. 9 is an exploded sectional view of an end of a developing roller in a fourth embodiment of the present disclosure.

Next, a developing roller 83R in a fourth embodiment of the present disclosure is described referring to FIG. 9. FIG. 9 is an exploded sectional view of an end of the developing roller 83R. In the fourth embodiment, the axial length of the developing roller 83R is also set to be shorter than the axial length of an unillustrated photosensitive drum. A sleeve small diameter portion 832R (small diameter portion) is formed at an end of a sleeve 830R (base member) of the developing roller 83R. The developing roller 83R is provided with a flange portion 835R constituted of a flange end portion 835AR and a press-fitting portion 835BR. The press-fitting portion 835BR of the flange portion 835R is pressed in the end of the sleeve 830R. Further, a coat layer 83CR (surface layer) is formed on the surface of the sleeve 830R in advance by an immersion process. The coat layer 83CR is formed to extend along the shape of a step between a sleeve middle portion 831R and the sleeve small diameter portion 832R.

In the fourth embodiment, the outer diameter L5 of the press-fitting portion 835BR is set to be equal to or larger than the inner diameter L6 of the axial end of the sleeve 830R. Therefore, when the flange portion 835R is mounted in the sleeve 830R, the press-fitting portion 835BR is pressed in the sleeve 830R, while expanding the inner periphery of the sleeve 830R by a pressing operation. This makes it possible to prevent disengagement of the flange portion 835R after the pressing operation. However, as described above, when the flange portion 835R is mounted, the sleeve small diameter portion 832R of the sleeve 830R is likely to expand. In view of the above, in the fourth embodiment, the value obtained by doubling the difference (L7) between the radius of the sleeve small diameter portion 832R and the radius of the axially middle portion of the sleeve 830R is set to be larger than the difference between the outer diameter of the press-fitting portion 835BR and the inner diameter of the axial end of the sleeve 830R, in other words, the value (L5-L6) in FIG. 9. According to this configuration, the amount of increase of the sleeve small diameter portion 832R accompanied by mounting of the flange portion 835R is smaller than the predetermined amount of reduction of the sleeve small diameter portion 832R with respect to the sleeve middle portion 831R. This is further advantageous in preventing partial reduction of the gap between the developing roller 83R and the photosensitive drum due to a pressing operation of the press-fitting portion 835BR.

Further, in the fourth embodiment, the value obtained by doubling the thickness (L8) of the coat layer 83CR is set to be larger than the difference between the outer diameter of the press-fitting portion 835BR and the inner diameter of the axial end of the sleeve 830R, in other words, the value (L5-L6) in FIG. 9. Specifically, the thickness of the coat layer 83CR is set to be larger than one-half of the difference between the outer diameter of the press-fitting portion 835BR and the inner diameter of the axial end of the sleeve 830R. This makes it possible to prevent the axial end of the coat layer 83CR from bulging radially outward with respect to the axially middle portion of the coat layer 83CR.

Furthermore, in the foregoing embodiments, toner is supplied from the magnetic roller 82 (82P, 82Q, 82R) to the developing roller 83 (83P, 83Q, 83R), and then, toner is supplied from the developing roller 83 (83P, 83Q, 83R) to the photosensitive drum 121. According to this configuration, as compared with a well-known one-component developing device and two-component developing device, a high AC voltage is applied to the developing roller 83 (83P, 83Q, 83R) in order to move toner. However, the developing roller 83 (83P, 83Q, 83R) is provided with the sleeve small diameter portion 832 (832P, 832Q, 832R). Therefore, it is possible to prevent partial reduction of the gap between the developing roller 83 (83P, 83Q, 83R) and the photosensitive drum 121, and to prevent voltage leakage at the axial end of the developing roller 83 (83P, 83Q, 83R).

In the foregoing, the image forming apparatus 1 according to each of the embodiments of the present disclosure has been described. The present disclosure is not limited to the above. For instance, the following modified embodiment may be applied.

Figure 10A:
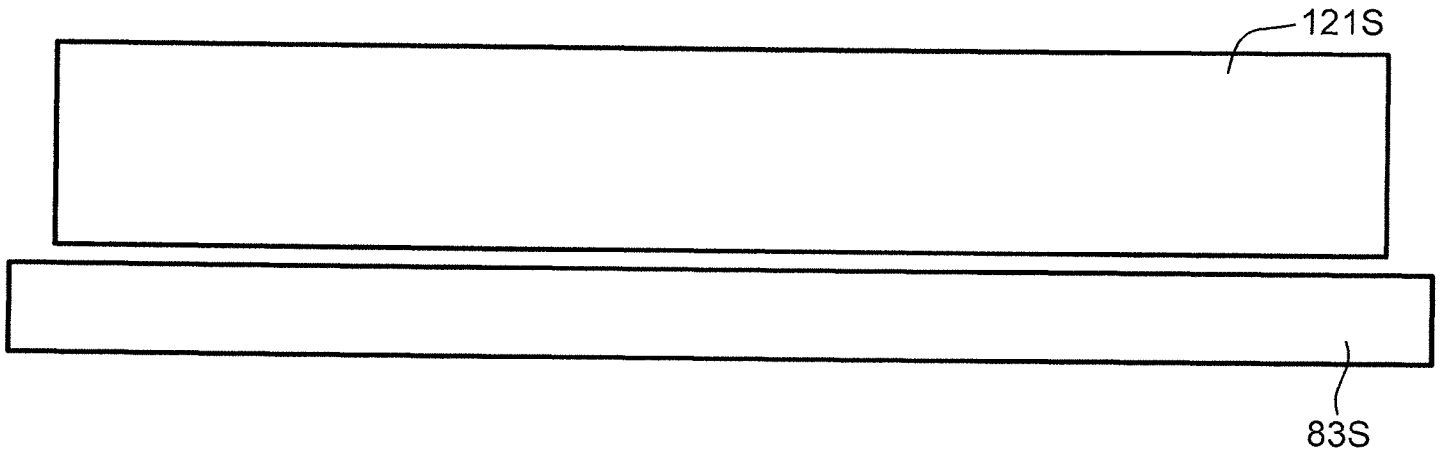
FIG. 10A is a schematic diagram illustrating a relationship between the axial length of a photosensitive drum and the axial length of a developing roller in a modified embodiment of the present disclosure.
Figure 10B:
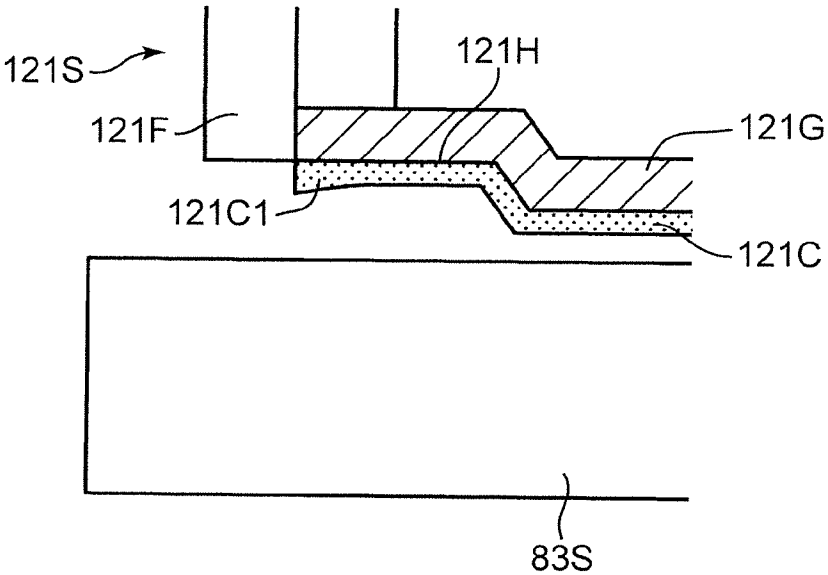
FIG. 10B is an enlarged sectional view of an axial end of the photosensitive drum in the modified embodiment of the present disclosure.

(1) In the foregoing embodiments, the sleeve small diameter portion 832 (832P, 832Q, 832R) is provided at the axial end of the developing roller 83 (83P, 83Q, 83R). The present disclosure is not limited to the above. FIG. 10A is a schematic diagram illustrating a relationship between the axial length of a photosensitive drum 121S and the axial length of a developing roller 83S in the modified embodiment of the present disclosure. FIG. 10B is an enlarged sectional view of an axial end of the photosensitive drum 121S. In the modified embodiment, the axial length of the photosensitive drum 121S is set to be shorter than the axial length of the developing roller 83S, and the photosensitive drum 121S is provided with a drum small diameter portion 121H (small diameter portion). The photosensitive drum 121S is provided with a drum member 121G (base member) made of aluminum. A flange portion 121F is mounted in an end of the drum member 121G. Further, a functional layer 121C (a charge generation layer, a charge transport layer) (surface layer) is formed on the surface of the drum member 121G by the same immersion process as applied to formation of the coat layer 83C of the developing roller 83 in the first embodiment. The functional layer 121C is formed to extend along the shape of the drum member 121G provided with the drum small diameter portion 121H. A thick portion 121C1 bulges from an axial end of the functional layer 121C.

Also in this configuration, providing the drum small diameter portion 121H on the drum member 121G in advance makes it possible to prevent partial reduction of the gap between the developing roller 83S and the photosensitive drum 121S at an axial end of the photosensitive drum 121S due to formation of the thick portion 121C1 or due to a pressing operation of the flange portion 121F. Alternatively, a portion devoid of the functional layer 121C may be formed at an axial end of the drum member 121G of the photosensitive drum 121S.

(2) In the first embodiment, the developing roller 83 is provided with the coat layer 83C, and the flange portions 835 are mounted in the sleeve 830 of the developing roller 83. The present disclosure is not limited to the above. The developing roller 83 may not be provided with the coat layer 83C, and the flange portions 835 may be mounted in the developing roller 83. Conversely to the above, the developing roller 83 may be provided with the coat layer 83C, and the flange portions 835 may not be mounted in the developing roller 83. The same idea is applied to a configuration, in which a small diameter portion is provided on the photosensitive drum 121.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developing device for supplying a developer to a photosensitive drum, which has a cylindrical shape, and is rotatable around an axis thereof for forming an electrostatic latent image on a circumferential surface thereof, comprising:

a developing roller disposed to face the photosensitive drum, the developing roller having a cylindrical shape, and being rotatable around an axis thereof for carrying a developer on a circumferential surface thereof, the developing roller including a cylindrical base member and a flange portion to be mounted in an axial end of the base member, the flange portion having a press-fitting portion to be pressed in an inner periphery of the base member, wherein the developing roller is provided with a small diameter portion formed at the axial end of the base member, the small diameter portion being a part of the circumferential surface of the developing roller, the small diameter portion extending from an axial end of the developing roller axially inward by a predetermined length and an axial length of the small diameter portion being longer than an axial length of the press-fitting portion, the small diameter portion having an outer diameter smaller than an axially middle portion of the developing roller.

2. The developing device according to claim 1, wherein an axial length of the developing roller is set to be shorter than an axial length of the photosensitive drum.

3. The developing device according to claim 1, wherein the developing roller further includes a press-fitted portion with an inner diameter is set to be large at the axial end of the base member so that the press-fitting portion is pressed in the press-fitted portion, and the axial length of the small diameter portion is set to be longer than the axial length of the press-fitted portion.

4. The developing device according to claim 1, wherein an outer diameter of the press-fitting portion is set to be equal to or larger than an inner diameter of the axial end of the base member, and a difference between the outer diameter of the small diameter portion and an outer diameter of the axially middle portion of the base member is set to be larger than a difference between the outer diameter of the press-fitting portion and the inner diameter of the axial end of the base member.

5. The developing device according to claim 1, wherein the small diameter portion is disposed on the circumferential surface of the developing roller on an axially outer side of an image forming area on the circumferential surface of the photosensitive drum where the electrostatic latent image is formed.

6. The developing device according to claim 1, wherein the developing roller includes a fixed magnet extending axially inward, an axial length of the fixed magnet is set to be smaller than an axial length of the developing roller, and the small diameter portion is disposed on an axial outer side of the fixed magnet.

7. An image forming apparatus, comprising:

the developing device of claim 1; and the photosensitive drum to which the developer is supplied from the developing roller.

8. The image forming apparatus according to claim 7, further comprising:

a bias voltage application portion, wherein the developing roller carries toner as the developer on the circumferential surface thereof, the developing device further includes a magnetic roller disposed away from the developing roller by a predetermined distance, the magnetic roller internally including an axially extending fixed magnet, and being rotatable while carrying the toner and carriers on a circumferential surface of the magnetic roller; and the bias voltage application portion applies a developing bias voltage to the developing roller and to the magnetic roller, the developing bias voltage being obtained by superimposing an alternate-current voltage with a direct-current voltage.

9. A developing device for supplying a developer to a photosensitive drum, which has a cylindrical shape, and is rotatable around an axis thereof for forming an electrostatic latent image on a circumferential surface thereof, comprising:

a developing roller disposed to face the photosensitive drum, the developing roller having a cylindrical shape, and being rotatable around an axis thereof for carrying a developer on a circumferential surface thereof, the developing roller including a cylindrical base member and a flange portion to be mounted in an axial end of the base member, the flange portion has a press-fitting portion to be pressed in an inner periphery of the base member, wherein the developing roller is provided with a small diameter portion, the small diameter portion being a part of the circumferential surface of the developing roller, the small diameter portion extending from an axial end of the developing roller axially inward by a predetermined length, the small diameter portion having an outer diameter smaller than an axially middle portion of the developing roller, the developing roller is provided with a surface layer to be formed by an immersion process of immersing the base member in such a manner that an axial direction of the developing roller is aligned with a vertical direction, and the small diameter portion is formed in advance on a lower end of the base member before the immersion process is applied.

10. A developing device for supplying a developer to a photosensitive drum, which has a cylindrical shape, and is rotatable around an axis thereof for forming an electrostatic latent image on a circumferential surface thereof, comprising:

a developing roller disposed to face the photosensitive drum, the developing roller having a cylindrical shape, and being rotatable around an axis thereof for carrying a developer on a circumferential surface thereof, the developing roller including a cylindrical base member and a flange portion to be mounted in an axial end of the base member, the flange portion has a press-fitting portion to be pressed in an inner periphery of the base member, wherein the developing roller is provided with a small diameter portion, the small diameter portion being a part of the circumferential surface of the developing roller, the small diameter portion extending from an axial end of the developing roller axially inward by a predetermined length, the small diameter portion having an outer diameter smaller than an axially middle portion of the developing roller, the developing roller is provided with a surface layer to be formed by an immersion process of immersing the base member in such a manner that an axial direction of the developing roller is aligned with a vertical direction, an outer diameter of the press-fitting portion is set to be equal to or larger than an inner diameter of an axial end of the base member, and a thickness of the surface layer is set to be larger than one-half of a difference between the outer diameter of the press-fitting portion and the inner diameter of the axial end of the base member.

* * * * *